US010129661B2

(12) United States Patent
Woods et al.

(10) Patent No.: US 10,129,661 B2
(45) Date of Patent: Nov. 13, 2018

(54) TECHNIQUES FOR INCREASING PROCESSING CAPABILITY IN HEAR AIDS

(71) Applicant: Starkey Laboratories, Inc., Eden Prairie, MN (US)

(72) Inventors: William S. Woods, Berkeley, CA (US); Martin McKinney, Minneapolis, MN (US); Tao Zhang, Eden Prairie, MN (US); Ivo Merks, Eden Prairie, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 43 days.

(21) Appl. No.: 15/061,320

(22) Filed: Mar. 4, 2016

(65) Prior Publication Data

US 2016/0261963 A1 Sep. 8, 2016

Related U.S. Application Data

(60) Provisional application No. 62/128,097, filed on Mar. 4, 2015.

(51) Int. Cl.
*H04R 25/00* (2006.01)

(52) U.S. Cl.
CPC ..... *H04R 25/505* (2013.01); *H04R 25/50* (2013.01); *H04R 25/554* (2013.01); *H04R 2225/39* (2013.01); *H04R 2225/41* (2013.01); *H04R 2225/61* (2013.01); *H04R 2460/05* (2013.01); *H04R 2460/07* (2013.01)

(58) Field of Classification Search
CPC .... H04R 25/505; H04R 25/50; H04R 25/554; H04R 2225/39; H04R 2225/41; H04R 2225/61; H04R 2460/05; H04R 2460/07
USPC ..... 381/314
See application file for complete search history.

(56) References Cited

U.S. PATENT DOCUMENTS

| | | | |
|---|---|---|---|
| 5,680,467 | A | 10/1997 | Hansen |
| 6,718,301 | B1 | 4/2004 | Woods |
| 7,106,870 | B2 | 9/2006 | Meier et al. |

(Continued)

FOREIGN PATENT DOCUMENTS

| | | | |
|---|---|---|---|
| EP | 1801786 | A1 | 6/2007 |
| EP | 2819436 | A1 | 12/2014 |
| WO | WO-2012066149 | A1 | 5/2012 |

OTHER PUBLICATIONS

"European Application Serial No. 16158768.8, Extended European Search Report dated Jun. 3, 2016", 8 pgs.

(Continued)

*Primary Examiner* — Sean H Nguyen
(74) *Attorney, Agent, or Firm* — Schwegman Lundberg & Woessner, P.A.

(57) ABSTRACT

The signal processing functions of a hearing aid as described above necessarily cause some delay between the time the audio signal is received by the microphone or wireless receiver and the time that the audio is actually produced by the output transducer. In some situations, signal processing incorporating longer delays may be better able to improve signal-to-noise ratio (SNR) or other functional parameters for a hearing aid wearer, but a balance should be struck between these positive effects of delay and other negative effects. The techniques described herein address the problem of balancing the positive and negative effects of delay.

13 Claims, 1 Drawing Sheet

(56) References Cited

U.S. PATENT DOCUMENTS

| | | | | |
|---|---|---|---|---|
| 7,428,312 | B2 | 9/2008 | Meier et al. | |
| 7,738,665 | B2 | 6/2010 | Dijkstra et al. | |
| 7,869,606 | B2 | 1/2011 | Fichtl et al. | |
| 8,054,999 | B2 | 11/2011 | Rasmussen | |
| 2014/0112483 | A1* | 4/2014 | Etter | H03G 3/3005 381/56 |
| 2014/0193009 | A1* | 7/2014 | Yousefian Jazi | G10L 21/0208 381/317 |
| 2014/0233762 | A1* | 8/2014 | Vilkamo | G10H 1/183 381/119 |
| 2015/0078575 | A1* | 3/2015 | Selig | H04R 1/1091 381/74 |
| 2015/0172831 | A1* | 6/2015 | Dittberner | H04R 25/70 381/314 |

OTHER PUBLICATIONS

"European Application Serial No. 16158768.8, Communication Pursuant to Article 94(3) EPC dated Dec. 6, 2017", 4 pgs.

"European Application Serial No. 16158768.8, Communication pursuant to Article 94(3) EPC dated Jul. 21, 2017", 6 pgs.

"European Application Serial No. 16158768.8, Response filed Nov. 24, 2017 to Communication pursuant to Article 94(3) EPC dated Jul. 21, 2017", 33 pgs.

* cited by examiner

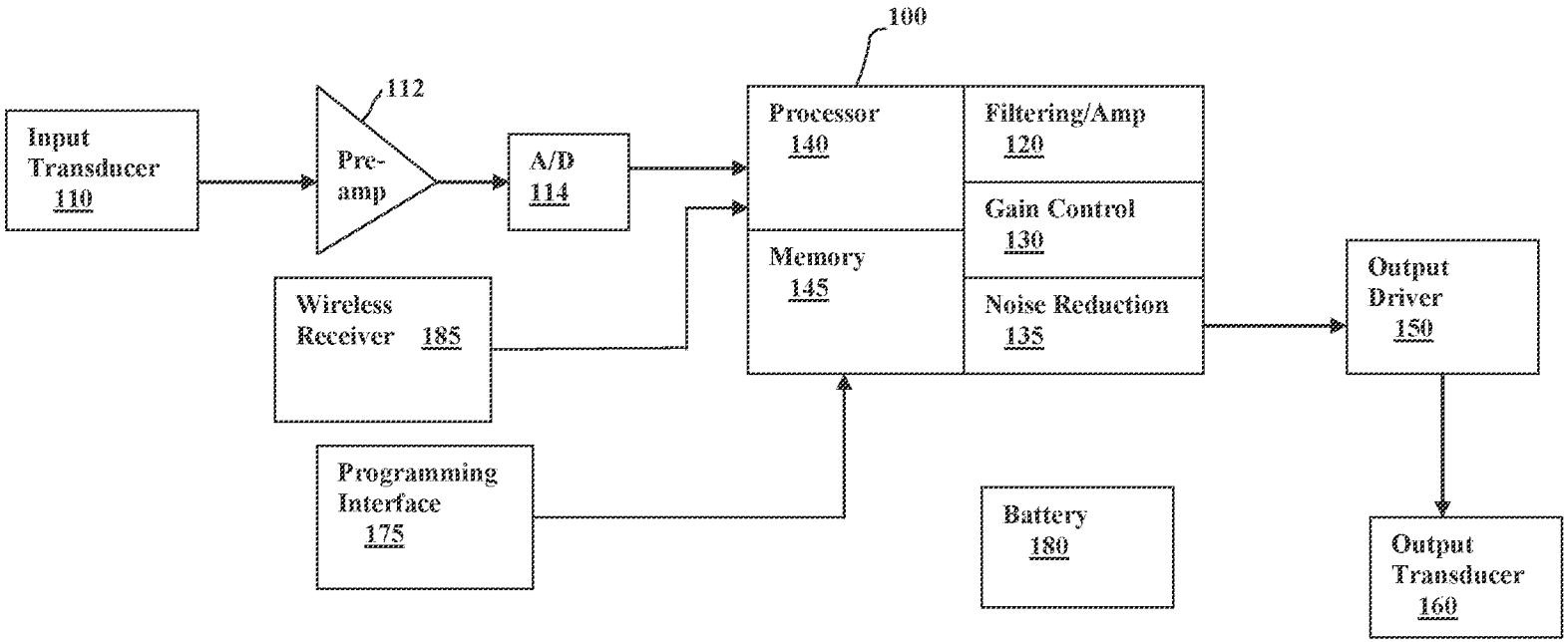
Input Transducer 110
112
Pre-amp
A/D 114
100
Processor 140
Filtering/Amp 120
Gain Control 130
Noise Reduction 135
Memory 145
Wireless Receiver 185
Programming Interface 175
Battery 180
Output Driver 150
Output Transducer 160

TECHNIQUES FOR INCREASING PROCESSING CAPABILITY IN HEAR AIDS

CROSS-REFERENCE TO RELATED APPLICATION

This patent application claims the benefit of U.S. Provisional Patent Application No. 62/128,097, filed Mar. 4, 2015, which is incorporated by reference herein in its entirety

FIELD OF THE INVENTION

This invention pertains to electronic hearing aids and methods for their operation.

BACKGROUND

Hearing aids are electronic instruments that compensate for hearing losses by amplifying sound. The electronic components of a hearing aid include a microphone for receiving ambient sound, an amplifier for amplifying the microphone signal in a manner that depends upon the frequency and amplitude of the microphone signal, a speaker for converting the amplified microphone signal to sound for the wearer, and a battery for powering the components.

BRIEF DESCRIPTION OF THE DRAWINGS

FIG. 1 shows the basic electronic components of an example hearing aid according to one embodiment.

DETAILED DESCRIPTION

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

A hearing aid is a wearable electronic device for correcting hearing loss by amplifying sound. The electronic circuitry of the device is contained within a housing that is commonly either placed in the external ear canal or behind the ear. Transducers for converting sound to an electrical signal and vice-versa may be integrated into the housing or external to it. The basic components of an exemplary hearing aid are shown in FIG. 1. A battery 180 supplies power for the electronic components of the hearing aid. A microphone or other input transducer 110 receives sound waves from the environment and converts the sound into an input signal. After amplification by pre-amplifier 112, the signal is sampled and digitized by A/D converter 114. Other embodiments may incorporate an input transducer that produces a digital output directly. The device's digital signal processing circuitry 100 processes the digitized input signal IS into an output signal OS in a manner that compensates for the patient's hearing deficit. The output signal OS is then passed to an output driver 150 that drives an output transducer for converting the output signal into an audio output, such as a speaker within an earphone (sometimes referred to as a receiver).

In the embodiment illustrated in FIG. 1, the signal processing circuitry 100 includes a programmable controller made up of a processor 140 and associated memory 145 for storing executable code and data. The overall operation of the device is determined by the programming of the controller, which programming may be modified via a programming interface 210. The programming interface 175 allows user input of data to a parameter modifying area of the memory 145 so that parameters affecting device operation may be changed. The programming interface 175 may allow communication with a variety of devices for configuring the hearing aid such as industry standard programmers, wireless devices, or belt-worn appliances.

Also shown in FIG. 1 is a wireless receiver 185 interfaced to the hearing aid's processing circuitry that may wirelessly receive audio signals from an external device such as a companion microphone, telephone, or other external wireless device. Communication between the wireless receiver and the external wireless device may be implemented as a near-field magnetic induction (NFMI) link or as a far-field RF (radio-frequency) link. In the latter case, the wireless receiver 185 may be, or include, a telecoil. The wireless receiver 185 produces a second input signal for the processing circuitry that may be combined with the input signal produced by the microphone 105 or used in place thereof. The wireless receiver 185 may also be configured to receive other signals besides audio signals such as programming information that is input to the programming interface 175 and location information from external sources such as global positioning system (GPS) signals.

The signal processing circuitry 100 may be implemented in a variety of different ways, such as with an integrated digital signal processor or with a mixture of discrete analog and digital components. For example, the signal processing may be performed by a mixture of analog and digital components having inputs that are controllable by the controller that define how the input signal is processed, or the signal processing functions may be implemented solely as code executed by the controller. The terms "controller," "module," or "circuitry" as used herein should therefore be taken to encompass either discrete circuit elements or a processor executing programmed instructions contained in a processor-readable storage medium.

The signal processing modules 120, 130, and 135 may represent specific code executed by the controller or may represent additional hardware components. The processing done by these modules may be performed in the time-domain or the frequency domain. In the latter case, the input signal is discrete Fourier transformed (DFT) prior to processing and then inverse Fourier transformed afterwards to produce the output signal for audio amplification. Any or all of the processing functions may also be performed for a plurality of frequency-specific channels, each of which corresponds to a frequency component or band of the audio input signal. Because hearing loss in most patients occurs non-uniformly over the audio frequency range, most commonly in the high frequency range, the patient's hearing deficit is compensated by selectively amplifying those frequencies at which the patient has a below-normal hearing threshold. The filtering and amplifying module 120 may therefore amplify the input signal in a frequency specific manner. The gain control module 130 dynamically adjusts the amplification in accordance with the amplitude of the input signal to either expand or compress the dynamic range and is sometimes referred to as a compressor. Compression decreases the gain of the filtering and amplifying circuit at high input signal levels so as to avoid amplifying louder sounds to uncomfortable levels. The gain control module may also apply such compression in a frequency-specific manner. The noise reduction module 135 performs functions such as suppression of ambient background noise and feedback cancellation.

The signal processing functions of a hearing aid as described above necessarily cause some delay between the time the audio signal is received by the microphone or wireless receiver and the time that the audio is actually produced by the output transducer. In some situations, such as a noisy restaurant, signal processing incorporating longer delays may be better able to improve signal-to-noise ratio (SNR) or other functional parameters for a hearing aid wearer, but a balance should be struck between these positive effects of delay and other, known, negative effects. Negative effects are due mainly to two interactions: between acoustically-leaked and processed signals (this is a problem for exogenously and endogenously produced sound), and between auditory and visual information which can become de-synchronized by the processing delay. Negative effects may also be encountered at long processing delays due to an interaction between a user's proprioceptive input and the received acoustic signal. For example, an asynchrony between when a user actually taps on a plate and the reception of the sound of the tap may occur. The techniques described herein address the problem of balancing the positive and negative effects of delay.

In one embodiment, the processing circuitry of the hearing aid implements a classifier working with an input audio signal or set of input audio signals (and/or other types of information) to select from processing algorithms or implementations differing in delay (and possibly other ways). This may be done using a default classifier, but also with a classifier that learns which processing to select based on feedback from a user. The classifier uses features of the input signals, rather than estimated benefit and delay from actual processing, to decide which processing to apply, and is thus less computationally intensive. Through the learning process it can also better customize signal processing selection to specific user's preference of balance of negative and positive delay effects.

In one embodiment, the classifier uses environment descriptors obtained from analysis of input signals and other information. These descriptors may include estimates of: the speech-to-noise ratio or SNR (see U.S. Pat. No. 6,718,301 hereby incorporated by reference), the direct-to-reverberant ratio, sound field diffuseness, and/or other information. The other information may include such things as GPS (global positioning system) location information and estimated speed (e.g., to identify car usage). This information could be used, for example, as follows. At high SNRs (greater than +5 dB), typical aid processing delay in the range below 10 ms is sufficient. For SNRs in the 0 to +5 dB range, processing imposing a delay upwards of 30 ms might be used to achieve higher frequency resolution and allow use of more temporal history for noise reduction or management. For SNRs in the −5 to 0 dB range, delays upwards of 50 ms might be used to instantiate processing from a multi-microphone wireless accessory or ad hoc network. For SNRs lower than −5 dB, delay upwards of 100 ms might be used to combine visual information with audio information for noise reduction.

To avoid own-voice issues the processing selection should also be sensitive to the relative levels of own voice and transduced sound in the user's ear canal. This may require processing that changes the range of frequency in which delay is increased, and may take advantage of information provided by techniques described in, U.S. Pat. No. 6,718,301.

The learning could be instantiated by having the system use different delay-inducing processing in the same conditions over time. The user could then have the option to keep the processing or go to another setting. Such testing could be done over time until a clear winner emerges.

EXAMPLE EMBODIMENTS

In one embodiment, a hearing aid, comprises: a microphone for converting an audio input into an input signal; processing circuitry for processing the input signal to produce an output signal in a manner that compensates for a patient's hearing deficit; a speaker for converting the output signal into an audio output; wherein the processing circuitry is configured to select a processing algorithm for processing the input signal based upon an analysis of the input signal. The processing circuitry may configured to analyze the input signal by implementing a classifier that classifies the input signal and selects from processing algorithms that differ in delay time in accordance with the classification of the input signal. The processing circuitry may be configured so that the classifier uses environment descriptors obtained from analysis of the input signals selected from a group of descriptors that includes: estimates of: the speech-to-noise ratio (SNR), direct-to-reverberant ratio, and sound field diffuseness. The processing circuitry may be configured so that the classifier uses GPS (global positioning system) location information and/or estimated speed to classify the input signal. The processing circuitry may configured to receive user preferences (e.g., via a wireless receiver or programming interface) with respect to different processing algorithms and modify the operation of the classifier in accordance therewith.

Hearing assistance devices typically include at least one enclosure or housing, a microphone, hearing assistance device electronics including processing electronics, and a speaker or "receiver." Hearing assistance devices may include a power source, such as a battery. In various embodiments, the battery may be rechargeable. In various embodiments multiple energy sources may be employed. It is understood that in various embodiments the microphone is optional. It is understood that in various embodiments the receiver is optional. It is understood that variations in communications protocols, antenna configurations, and combinations of components may be employed without departing from the scope of the present subject matter. Antenna configurations may vary and may be included within an enclosure for the electronics or be external to an enclosure for the electronics. Thus, the examples set forth herein are intended to be demonstrative and not a limiting or exhaustive depiction of variations.

It is understood that digital hearing aids include a processor. In digital hearing aids with a processor, programmable gains may be employed to adjust the hearing aid output to a wearer's particular hearing impairment. The processor may be a digital signal processor (DSP), microprocessor, microcontroller, other digital logic, or combinations thereof. The processing may be done by a single processor, or may be distributed over different devices. The processing of signals referenced in this application can be performed using the processor or over different devices. Processing may be done in the digital domain, the analog domain, or combinations thereof. Processing may be done using subband processing techniques. Processing may be done using frequency domain or time domain approaches. Some processing may involve both frequency and time domain aspects. For brevity, in some examples drawings may omit certain blocks that perform frequency synthesis, frequency analysis, analog-to-digital conversion, digital-to-analog conversion, amplification, buffering, and certain types of filtering and processing. In various embodiments the processor is adapted to perform instructions stored in one or more memories, which may or may not be explicitly shown. Various types of memory may be used, including volatile and nonvolatile forms of memory. In various embodiments, the processor or other processing devices execute instructions to perform a number of signal processing tasks. Such embodiments may include analog components in communication with the processor to perform signal processing tasks, such as sound reception by a microphone, or playing of sound using a receiver (i.e., in applications where such transducers are used). In various embodiments, different realizations of the block diagrams, circuits, and processes set forth herein can be created by one of skill in the art without departing from the scope of the present subject matter.

It is further understood that different hearing assistance devices may embody the present subject matter without departing from the scope of the present disclosure. The devices depicted in the figures are intended to demonstrate the subject matter, but not necessarily in a limited, exhaustive, or exclusive sense. It is also understood that the present subject matter can be used with a device designed for use in the right ear or the left ear or both ears of the wearer.

The present subject matter is demonstrated for hearing assistance devices, including hearing aids, including but not limited to, behind-the-ear (BTE), in-the-ear (ITE), in-the-canal (ITC), receiver-in-canal (RIC), or completely-in-the-canal (CIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user, including but not limited to receiver-in-canal (RIC) or receiver-in-the-ear (RITE) designs.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. A hearing aid, comprising:

a microphone to convert an audio input into an input signal;

processing circuitry to process the input signal to produce an output signal in a manner that compensates for a user's hearing deficit;

a speaker to convert the output signal into an audio output;

wherein the processing circuitry is configured to select from two or more processing algorithms that differ in delay time to produce the output signal and to select the processing algorithm according to an estimated signal-to-noise ratio (SNR) of the audio signal received by the microphone;

wherein the processing circuitry is configured to select a processing algorithm with a delay of 10 milliseconds or less when the SNR is greater than +5 dB; and wherein the processing circuitry is, at least one of, configured to select a processing algorithm with a delay of 30 milliseconds or more when the SNR is between 0 and +5 dB, configured to select a processing algorithm with a delay of 50 milliseconds or more when the SNR is between −5 and 0 dB, or configured to select a processing algorithm with a delay of 100 milliseconds or more when the SNR is less than −5 dB.

2. The hearing aid of claim 1 further comprising:

a wireless receiver interfaced to the processing circuitry; and, wherein the processing circuitry is configured to select a processing algorithm based upon global positioning system (GPS) signals received by the wireless receiver.

3. The hearing aid of claim 2 wherein the processing circuitry is further configured to select a processing algorithm according to the location of the user as determined from the GPS signals.

4. The hearing aid of claim 1 wherein the processing circuitry is further configured to select a processing algorithm according to an estimated direct to reverberant ratio of the audio signal received by the microphone.

5. The hearing aid of claim 1 wherein the processing circuitry is further configured to select a processing algorithm according to an estimate of sound field diffuseness in the audio signal received by the microphone.

6. The hearing aid of claim 1 wherein the processing circuitry is further configured to select a processing algorithm according to an estimate of relative levels of the user's voice and other sound received by the microphone.

7. The hearing aid of claim 1 further comp rising;

a programming interface interfaced to the processing circuitry; and wherein the processing circuitry is further configured to select a processing algorithm based upon signals received from the user via the programming interface.

8. The hearing aid of claim 1 wherein the processing circuitry is configured to select different processing algorithms in identical environments over time and receive user preferences for those different processing algorithms via the programming interface.

9. A method for operating a hearing aid, comprising:

converting an audio input into an input signal;

processing the input signal to produce an output signal in a manner that compensates for a user's hearing deficit;

converting the output signal into an audio output;

selecting from two or more processing algorithms that differ in delay time to produce the output signal and selecting the processing algorithm according to an estimated signal-to-noise ratio (SNR) of the audio signal received by the microphone;

selecting a processing algorithm with a delay of 10 milliseconds or less when the SNR is greater than +5 dB; and, at least one of, selecting a processing algorithm with a delay of 30 milliseconds or more when the SNR is between 0 and +5 dB, selecting a processing algorithm with a delay of 50 milliseconds or more when the SNR is between −5 and 0 dB, or selecting a processing algorithm with a delay of 100 milliseconds or more when the SNR is less than −5 dB.

10. The method of claim 9 further comprising selecting a processing algorithm based up on global positioning system (GPS) signals received by a wireless receiver.

11. The method of claim 10 further comprising selecting a processing algorithm according to the location of the user as determined from the GPS signals.

12. The method of claim 10 further comprising selecting a processing algorithm according to an estimated speed of the user as deter mined from the GPS signals.

13. The method of claim 9 further comprising selecting a processing algorithm according to an estimated direct to reverberant ratio of the audio signal received by the microphone.

* * * * *